United States Patent [19]

Weikel, Jr.

[11] 4,060,235

[45] Nov. 29, 1977

[54] SELF-LIFTING VACUUM STRIPPER

[75] Inventor: Donald J. Weikel, Jr., Rochester, N.Y.

[73] Assignee: Xerox Corporation, Stamford, Conn.

[21] Appl. No.: 719,642

[22] Filed: Sept. 1, 1976

[51] Int. Cl.[2] ..... B65H 29/56

[52] U.S. Cl. ..... 271/174; 271/194; 271/DIG. 2

[58] Field of Search ..... 271/174, DIG. 2, 172, 271/103, 80, 194

[56] References Cited

U.S. PATENT DOCUMENTS

| | | | |
|---|---|---|---|
| 3,774,907 | 11/1973 | Borostyan | 271/DIG. 2 |
| 3,867,026 | 2/1975 | Ogawa | 271/DIG. 2 |

OTHER PUBLICATIONS

Massey, J. H., "Double Document Separator," IBM Technical Disclosure Bulletin, vol. 14, No. 8, Jan. 1972, pp. 2414, 2415.

*Primary Examiner*—Bruce H. Stoner, Jr.

[57] ABSTRACT

In a copying apparatus in which copy sheets are stripped from a reusable imaging surface after the images have been transferred thereto, a vacuum stripping system is provided in which a pivotable, highly apertured, stripping head is normally closely spaced from the imaging surface and connected to a vacuum source to pneumatically capture the lead edge area of the copy sheet. The coverage of the vacuum apertures in the stripping head by the captured sheet pneumatically lifts the stripping head away from the imaging surface into alignment with a copy sheet transport, and shifts the stripping point of the body of the copy upstream on the imaging surface.

6 Claims, 2 Drawing Figures

SELF-LIFTING VACUUM STRIPPER

Figure 1:
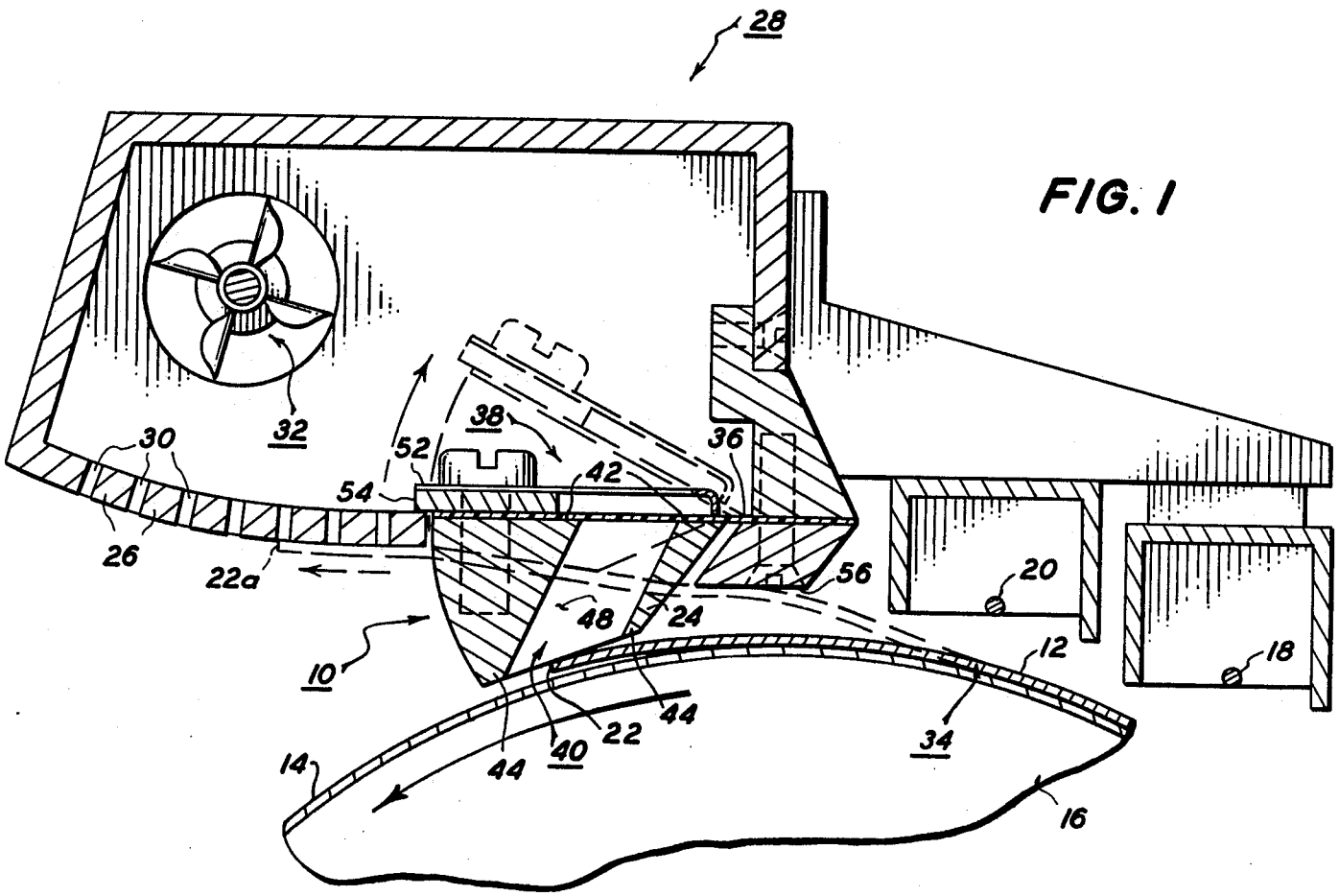

The present invention relates to image transfer copying, and in particular to an apparatus and method for improved vacuum stripping of copy sheets from an initial image support surface.

The accurate and reliable transport of copy sheets, particularly cut paper, through the several work stations of electrostatographic or other copying systems is a well known problem particularly due to the highly variable nature of such materials. Paper jams are one of the main causes of copying machine shutdowns. The image transfer station in an electrostatographic copier has a particular sheet handling problem because of electrical and pressure effects on the sheet, and limitations of the type of sheet handling apparatus which can be utilized without damaging the reusable imaging surface or affecting the transfer process by disturbing the image before or after transfer.

In a conventional transfer station in xerography a previously developed image of toner (image developer material) is transferred from the photoreceptor (the original support and imaging surface) to an overlying copy sheet (the final support surface or transfer member). The copy sheet is then stripped from the photoreceptor without disturbing the toner image thereon. The toner thus transferred is then fixed to the copy sheet in a subsequent thermal or other fusing station.

In xerography, this image transfer is most commonly achieved by electrostatic force fields created by D.C. charges applied to or adjacent the back of the copy sheet while the front side of the copy sheet contacts the toner bearing photoreceptor surface. The transfer fields must be sufficient to overcome the forces holding the toner onto the photoreceptor and to attract the toner over onto the copy sheet. These transfer fields are generally provided in one of two ways: by ion emission of D.C. charges from a transfer corotron deposited onto the back of the copy paper, or by a D.C. biased transfer roller or belt rolling along the back of the paper and holding it against the photoreceptor. In either case the copy sheet is held in registration with, and moved together with, the imaging surface in order to transfer a registered and unsmeared image. In the case of transfer accompanied by D.C. charges applied to the back of the copy sheet, these charges provide a substantial "tacking" force which electrostatically holds the copy sheet against the imaging surface.

Thus, a particularly difficult problem in modern xerographic systems is the reliable and consistent stripping of the copy sheet off of the imaging surface after the transfer of the image has been accomplished. Due to practical space and time constraints, this must generally be done as closely as possible after the transfer step, yet without disturbing the transferred toner image on the copy sheet. The unfused toner image is readily disturbed by either mechanical or electrostatic forces. Yet in order to separate the copy sheet from the photoreceptor, the electrostatic tacking bond and other forces therebetween must be overcome.

Various stripping systems have been utilized in the prior art. One such system is an air puffer applying a jet of air towards the lead edge of the copy sheet to initiate its separation from the imaging surface, as described, for example, in U.S. Pat. No. 3,062,536 to J. Rutkus, Jr., et al. Other stripping systems use stripping fingers for mechanically catching the thin lead edge of the copy sheet. Both of these systems can cause image disruptions under certain circumstances. Stripping fingers can scratch or rub against the imaging surface or mis-strip if their stripping lead edges are not maintained critically closely positioned relative to the imaging surface. An example of such a mechanical stripping system is disclosed in U.S. Pat. No. 3,578,859, issued May 18, 1971, to W. R. Stillings.

This Stillings patent also discloses an example of a vacuum sheet transport manifold system spaced from the photoreceptor and forming a part of the stripping system after stripping of the lead edge has been initiated by the stripping finger. The present invention is particularly suitable in a vacuum copy sheet guide manifold stripping system as is disclosed in the following copending U.S. Patent applications of the same assignee: Ser. No. 681,309, filed April 1976, now U.S. Pat. No. 4,017,065 by Raymond E. Poehlein, and Ser. No. 687,439, filed May 1976, by Thomas Skaper and David P. VanBortel.

In the mechanical stripping finger art, a British patent specification No. 1,387,686, published Mar. 19, 1975, by Kabushiki Kaisha Ricoh is noted. It suggests that when the drum rotates the leading edge of a sheet on the surface of the drum engages the separators and the continued movement of the sheet pivots the separator away from the drum and causes the leading edge of the sheet to be diverted toward the sheet conveyor means.

It is known to utilize air flotation or pneumatic sensing and controls to control the critical spacing of a mechanical stripping finger from the imaging surface, using mechanical stripping fingers with pneumatic apertures therethrough. Examples thereof are described in U.S. Pat. No. 3,804,401, issued Apr. 16, 1974 to Klaus K. Stange; U.S. Pat. No. 3,837,640, issued Sept. 24, 1974, to James R. Norton et al; and U.S. Pat. No. 3,891,206, issued June 24, 1975, to Ari Bar-On. All of these stripping systems rely on the direct mechanical interception of the upstream edge of the stripper finger against the downstream or leading edge of the copy sheet to effect stripping. That is, they utilize positive air pressure to position the stripping finger as opposed to providing vacuum sheet stripping.

A presently preferred different form of sheet stripping, to which the present invention relates, is known as vacuum stripping. The lead edge area of the copy sheet is attracted toward vacuum ports or apertures in a vacuum stripping head only by the air flows towards the apertures. A pneumatic vacuum source is connected to these vacuum ports continuously or intermittently. The stripping head may be stationarily mounted at a substantial distance from the imaging surface and still provide effective stripping in conjunction with or as a back-up for an electrostatic stripping system as disclosed in U.S. Pat. No. 3,870,515 to N. H. Kaupp, cited below. A current example is disclosed in U.S. Pat. No. 3,895,793 issued July 22, 1975, to John J. Bigenwald. A much greater and much less critical spacing between the vacuum stripping head and the imaging surface can be provided as compared to a mechanical stripping system, thus precluding any contact therebetween. It is also known that a vacuum sheet stripping device can be provided in which the vacuum stripping member is mechanically rotated to advance the separated copy sheet therewith as disclosed in U.S. Pat. 3,774,907, issued Nov. 27, 1973 to Steven Borostyan.

It is particularly desirable to initiate or enhance stripping of a copy sheet from an imaging surface by using the self-straightening tendency or beam strength of a copy sheet in conjunction with a curved area of the imaging surface and a detacking corotron which is substantially neutralizing the tacking transfer charges remaining on the copy sheet. This is taught in U.S. Pat. No. 3,870,515 issued Mar. 11, 1975, to Norbett H. Kaupp, and is disclosed in U.S. Pat. No. 3,357,400, issued Dec. 12, 1967, to A. T. Manghirmalani and U.S. Pat. No. 3,506,259, issued Apr. 14, 1970, to J. P. Caldwell et al. The present invention is preferably employed in combination with such detacking stripping systems.

It is known to desirably control the actual separating or stripping point of the body of the copy sheet from the imaging surface relative to the detacking corotron emission area so that the detacking corotron is acting on a substantial portion of the body of the copy sheet after its initial separation from the imaging surface. The system disclosed herein provides this advantage. This stripping position location is discussed in U.S. Pat. No. 3,885,785, issued May 27, 1975 to Robert A. Burkett et al. This patent also shows a stationary stripping head vacuum stripping system. Shifting the stripping point for the lead edge vis-a-vis the body of the copy sheet with a mechanical stripper is discussed in an application Ser. No. 689,277, filed May 24, 1976, by Gerald M. Fletcher of the same assignee (D/74360Q).

The stripping system of the invention overcomes many of the above-discussed problems and provides many of the above-discussed advantages with a simple and inexpensive modification of conventional vacuum stripping systems providing a vacuum stripping head which automatically prematurely lifts away from the imaging surface in response to the vacuum capture of the sheet being stripped. It may be utilized for stripping copy sheets from an imaging surface of any desired orientation or configuration, including both cylindrical and belt imaging surfaces, and for duplex as well as simplex transfer systems. The terms "copy" and "copy sheet" stripping as referred to herein will be understood to include the lead edges of webs to be subsequently severed as well as conventional pre-cut sheets, cards, etc., and various sheet materials such as plastics as well as paper.

The above-cited and other references teach details of various suitable exemplary xerographic structures, materials, systems and functions known to those skilled in the art, and thus are incorporated by reference in this specification to the extent appropriate.

Further objects, features and advantages of the invention pertain to the particular apparatus, steps and details whereby the above-mentioned aspects of the invention are attained.

Figure 2:
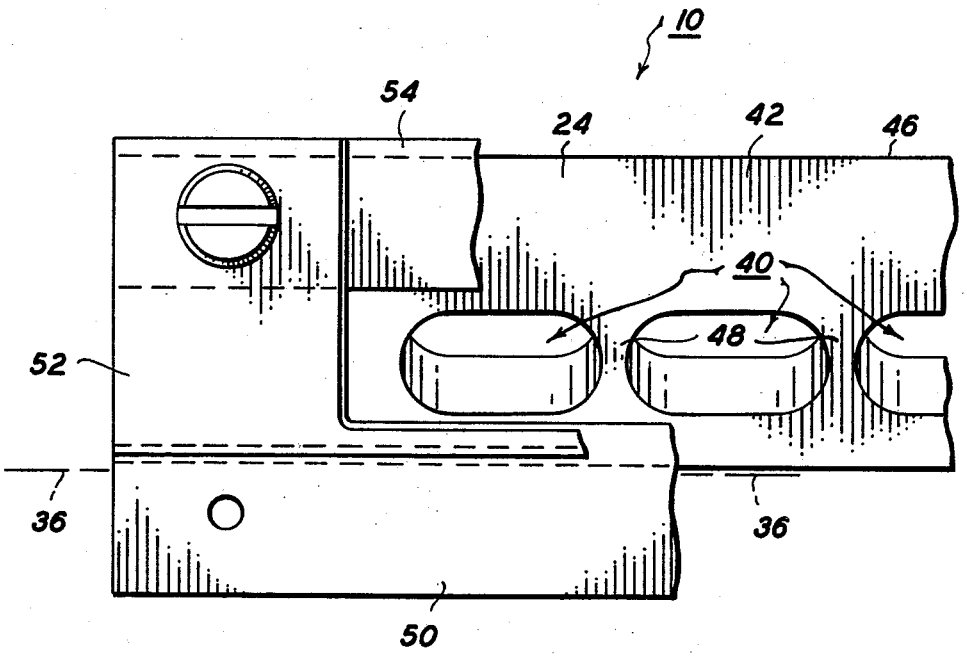

Accordingly, the invention will be better understood by reference to the following description of one example thereof, and to the drawings forming a part thereof wherein:

FIG. 1 is a first exemplary embodiment of the invention illustrating in a side view a transfer and stripping station in accordance with the present invention in an otherwise known xerographic apparatus; and FIG. 2 is an enlarged view of the stripping head of FIG. 1.

Referring now the drawings, and specifically to the embodiment 10 of FIGS. 1–2, it may be seen that the xerographic transfer, stripping and vacuum manifold transport system illustrated therein is generally similar in many respects to that of known xerographic copiers. The above-cited disclosures or other references may be referred to for additional descriptions of examples of appropriate or conventional details of such systems. Accordingly, the following description will be directed specifically to the novel aspects of the embodiment providing the above-noted stripping improvements.

However, briefly first describing the conventional aspects of the disclosed system 10 in FIG. 1, it may be seen that a copy sheet 12 is sequentially brought into contact with, and transported at the same speed as, the initial image bearing surface 14 of a moving photoreceptor drum 16. The copy sheet 12 passes under a transfer corona generator 18 which applies electrostatic transfer charges to the back of a copy sheet and electrostatically tacks the copy sheet against the photoreceptor surface 14. The copy sheet 12 is then transported on the photoreceptor surface 14 under a detacking corona generator 20 which substantially reduces the transfer charges thereon, preferably with an alternating current corona emission. The lead edge area 22 of the copy sheet 12 is then stripped from the photoreceptor surface 14 here by a vacuum stripping head 24, shown individually in FIG. 2. The position of the copy sheet lead edge area 22 just as stripping is initiated as illustrated here by its solid line position.

As soon as the copy sheet lead edge area 22 has been stripped from the photoreceptor surface 14, as shown by the dashed line position 22*a* of the copy sheet 12, it is attracted to the smooth, vacuum apertured, stationary guide surface 26 of a vacuum manifold unit 28. The surface 26 has a plurality of vacuum apertures 30 capable of attracting and retaining the copy sheet 12 in intimate sliding contact over the guide surface 26 as the sheet 12 continues its downstream movement.

The continuous electrostatic attachment of a changing intermediate segment of the copy sheet 12 behind its lead edge to the moving surface 14 provides the driving force for the copy sheet. The copy sheet is driven forward (downstream) at the same velocity as the photoreceptor surface 14. The stripped copy sheet 12 therefore slides downstream over the guide surface 26, and past any further sheet guide members, toward the nip of a roll fuser or other fusing system.

A vacuum is applied to the interior of the vacuum manifold unit 28 from a single vacuum pump 32, which may be a conventional simple axial fan or centrifugal blower motor unit. An appropriate vacuum level inside the vacuum manifold may, for example, be approximately one and one-half inches of water or approximately 3.8 grams per square centimeter. The vacuum pump 32 may be located at any desired position within the machine and connected by a vacuum conduit to the rear wall of the vacuum manifold unit 28, for example.

A minimum pressure level of a vacuum may be maintained in the interior or plenum chamber of the manifold unit 28 and, therefore, at the vacuum apertures 30 therein, at all times. This prevents, unless desired, the copy sheet from falling away or buckling away from the guide surface 26 of the vacuum manifold and fixes the path of the copy sheet body once the lead edge area has been stripped. That is, the paper path from the photoreceptor stripping point 34 to the vacuum manifold is consistent for all of the body of the copy sheet except the lead edge. That is, after the initial lead edge stripping, the point 34 at which the body of the copy sheet strips from the photoreceptor is constant and is maintained by the stationary configuration and spacing of the upstream area of the vacuum manifold unit guide surface here relative to the imaging surface since the copy sheet is maintained thereagainst. Thus, shifting or changing of the stripping point 34 of the copy sheet from the photoreceptor surface is prevented once the copy sheet lead edge has been captured by the vacuum manifold. This is important to prevent changes in the copy sheet residual charge level at stripping, since stripping desirably occurs during detacking under the emissions area of the detacking corona generator 20.

Considering now some of the major areas of difference between the system 10 and prior systems of this type, the vacuum stripping head 24 will now be discussed. It may be seen that here the stripping head 24 is an integral part of the vacuum manifold unit 28. The stripping head 24 is a relatively small portion of the vacuum manifold unit 28, pivotally mounted to the rest of the manifold unit about a pivotal axis 36 to pivot through an opening 38 in the upstream area of the guide surface 26 of the manifold unit 28. This axis 36 is transverse and spaced above the paper path direction along the imaging surface 14 and extends along the upstream edge of the stripping head 24. The stripping head 24 is freely pivotable about the axis 36 toward and away from the imaging surface 14 illustrated by its respective solid line and dashed line positions.

Means are provided to urge or normally bias the stripping head 24 towards and into a normal (solid line) stripping position closely overlying the initial image support surface 14. This normal biasing is provided here by the weight of the stripping head 24 and its eccentric mounting over the imaging surface 14. However if this stripping system had a different orientation, such as underneath the imaging surface 14, then a simple spring arrangement inside the manifold unit 28 could be used to similarly urge the pivotal stripping head 24 outwardly through the manifold opening 38 into its normal position for stripping. This spring could be a non-linear or over-center type, if desired.

The vacuum stripping force is provided here through a plurality of large stripping apertures or ports 40 extending through the stripping head 24 from an interior surface 42 of the stripping head to an opposing exterior surface 44 thereof. The stripping apertures 40 provide a relatively unrestricted air flow communication between the evacuated interior of the vacuum manifold unit 28 and the exterior or stripping surface 44 of the stripping head 24.

With the above-described arrangement, the stripping surface 44 of the stripping head 24 may be positioned at the most desirable spacing for vacuum stripping of the lead edge area of the copy sheet as the copy sheet passes thereunder. A spacing between the surface 44 and the imaging surface 14 of between approximately 20 to 80 thousands of an inch, e.g., 0.03 or 0.04 inches is preferred. The spacing of the closest portion, the downstream lip of the stripper head, should not be too close or have too high an air flow as to ingest an excessive amount of any toner on the drum surface of the lead edge of the copy sheet. Greater spacings, e.g., 0.25 inches are possible.

However, this close spacing of the stripping head 24 from the imaging surface 14 for stripping is not desirably maintained once the lead edge area 22 of the copy sheet has been effectively vacuum stripped or captured by the air flow pattern generated by the stripping apertures 40. Rather, it is desirable to maintain the point of contact between the copy sheet and the stripping system in a different position after the lead edge has been stripped in order to shift the stripping point upstream from the vacuum stripping head along the imaging surface 14 to the stripping point 34. It is also desirable to positively lift the lead edge area up away from the imaging surface 14 into engagement with the copy sheet transport means for transporting the copy sheets away from the imaging surface. It is also desirable that the copy sheet transport means be maintained substantially spaced away from the initial image support surface and have a relatively linear on planar path for the copy sheet 12.

The structure disclosed herein provides all these features. The stripping head 24 here is automatically self-actuated through the vacuum system provided by the pneumatic attraction of the copy sheet lead edge area 22 to the stripper head 24 during the stripping to automatically move the stripper head away from the imaging surface toward the further copy sheet transport and to positively hold and lift the lead edge area 22 with the stripper head. The stripper head is movably mounted for rapid movement away from the imaging surface. Its movement is provided solely by the same vacuum pump 32 which is applying a vacuum to the stripper head 24 and through the stripping apertures 40 to the pneumatically attracted lead edge area of the copy sheet. That is, the stripper head 24 is self-pivotable into and out of alignment with the sheet guide surface 26 of the vacuum manifold unit 28 solely by the vacuum provided within the vacuum manifold unit 28 by the vacuum pump 32.

The vacuum pump 32 may be a constant speed unit which would normally (without external changes) apply a substantially constant vacuum to the interior of the manifold unit 28, and therefore to the entire interior surface 42 of the stripping head (both the apertured portions thereof and the unapertured area thereof). The stripping head 24 may be thought of as a pivotable pneumatic piston, where the piston area to which the vacuum force is applied is the interior surface 42 and the apertures 40. The cylinder for this piston is provided here by the relatively closely fitting opening 38 into the manifold unit 28 through which the stripping head 24 is pivotable. As shown in FIG. 1, the stripping head 24 here has an unapertured rear (downstream) side with a partially cylindrical configuration having a surface curvature corresponding to its radius from the axis 36 so to maintain a close fit, i.e., pneumatic seal, around the stripping head 24 in any position of the stripping head.

As shown particularly in FIG. 2, the stripping head 24 may have a consistent or constant cross section across the paper path and a narrow elongated shape. It may be seen that the ratio of the apertured surface area to the non-apertured surface area of the stripper head is quite large. Preferably at the exterior surface 44 this ratio is greater than approximately 1 to 1, and in general the higher the better, e.g., ten to one or greater depending on mechanical construction constraints. Thus, the stripping head 24, even though it is preferably constructed from metal, plastic, or other relatively dense material, has a substantially hollow interior and light weight relative to its overall size due to the large dimensions and close spacings of the apertures 40 in comparison to the overall size of the stripping head 24.

As shown in FIG. 2, the stripping apertures are separated by inter-connecting webs 48 of the stripping head material. These webs 48 provide structural integrity for the stripping head and provide copy sheet guides in the direction of the paper path to prevent the lead edge of the copy sheet from catching on or entering the stripping apertures 40 from either the applied vacuum or an upward curl in the paper lead edge. Thus, the exterior surface 42 is effectively uniformly planar to the copy sheets even though highly apertured.

As indicated above, the vacuum system here applies a vacuum to both the apertured and unapertured areas of the interior surface 42 of the stripping head 24. The vacuum applied to the apertured areas is transmitted directly and substantially unobstructively through these stripping apertures 40 down to the correspondingly apertured areas of the exterior surface 44 of the stripping head to provide for the vacuum stripping. In the normal position and condition of the stripping head 24, i.e., when a copy sheet is not present, the stripping apertures 40 are unobstructed by any copy sheets. Thus, the vacuum system provides a first pneumatic pressure differential between the surface 42 and the surface 44 of the stripper head which pressure differential is basically due only to the vacuum applied to the unapertured surface area of the interior surface 42 versus the ambient air pressure at the unapertured area of the exterior surface 44. This first pressure differential is insufficient to overcome the gravitational bias urging the stripper head toward the imaging surface. Therefore, there is normally an insufficient force to move the stripping head away from the imaging surface.

In contrast, once a copy sheet lead has passed under the stripper head and has been captured by it, the apertures 40 will be at least partially, if not substantially, covered by the lead edge area of the copy sheet. This substantially blocks the air flow through the stripping apertures 40 so covered. This creates a second or higher pneumatic pressure differential and force between the surfaces 42 and 44 of the stripper head, which second pressure differential is sufficient to rapidly move the stripper head 24 away from the imaging surface toward the vacuum manifold unit 28. This self-lifting movement does not require the use of any mechanical or other actuation, drive or sensing means. Rather it is automatically accomplished by, and responsive only to, the actual capture of the copy sheet by the vacuum stripping ports 40. It does not require any interconnection, timing or coordination with any other machine components of the copier. The increase in vacuum force acting upon an effectively larger area self-lifts the stripping head 24. Since the copy sheet lead edge is maintained against the surface 44 as the stripping head pivots, this attached area of the copy sheet moves together with the surface 44 of the stripper head and is positively lifted in a controlled manner up to the sheet transport, here the vacuum guide surface 26.

Various mounting arrangements for pivotally mounting the stripping head to the vacuum manifold unit may be employed. A preferred system illustrated here utilizes a conventional continuous hinge of sheet plastic material 50. One side of the flexible sheet 50 is secured to the vacuum manifold unit 28 and forms a hinge line providing the pivot axis 36 for the stripping head by providing the only connection between the stripping head and the manifold unit. The opposite edge of flexible sheet 50 is clamped to the upstream edge of the stripper head by a clamp 52. Both of these members are cut-out or apertured to avoid obstruction of any of the vacuum apertures.

Appropriate conventional mechanical stops are preferably provided to limit the extremes of pivotal movement of the stripping head 24 to the two desired positions, i.e., the normal stripping position with the above-discussed closed spacing from the imaging surface, and the self-lifted position in which the stripping surface 44 of the stripping head is raised into alignment with the guide surface 26 for the further transport of the copy sheet away from the imaging surface. A stop defining the former minimum spacing (normal position) from the imaging surface may be provided by a flange or lip 54 extending from the interior surface 42 of the stripping head out beyond its rear side 46 and across that side of the manifold opening 38 to normally overlie and abut the interior of the vacuum manifold unit 28 as shown in FIG. 1.

It will be noted that the second and higher pneumatic pressure differential across the stripper head is the sum of the pre-existing pneumatic pressure differential from the unapertured surface area of the stripping head which is exposed to the vacuum plus the substantially increased pressure differential due to the pneumatic pressure exerted against these areas of the copy sheet which are overlying or blocking the vacuum ports 40 of the exterior surface 44 of the stripping head. The pneumatic forces on the areas of the copy sheet overlying vacuum ports are transmitted directly to the surrounding unapertured areas (web 48, etc.) of the stripping surface 44 to provide forces all acting at a distance from the axis of rotation 36 of the stripping head to rotate it.

While the vacuum pump 32 applying the vacuum to the interior of the manifold unit 28 may be a conventional constant speed type, which would normally provide a generally constant vacuum, it will be appreciated that the actual vacuum level within the manifold unit 28 which is applied to the stripping head 24 and the apertures 40 may desirably fluctuate. The decrease in the air flow rate through the vacuum stripping apertures 40 due to their obstruction by the captured copy sheet can provide a substantial increase in the vacuum within the manifold unit. This provides a further, substantial additional increase in the pneumatic pressure differential across the stripper head providing an additional lifting force on the stripper head since both the vacuum pressure level and its effective area are increased. In contrast, in the normal non-stripping condition of the system it is desirable that the vacuum level within the manifold unit 28 be quite low to reduce the return force bias needed, and to insure a greater force differential between the open and closed (by the paper) stripping port conditions, and to decrease toner and contaminant pick-up. With a small capacity vacuum pump and a substantially unrestricted air flow through a correspondingly large area of apertures 40 the normal pressure within the vacuum manifold can be maintained only slightly below ambient pressure until stripping occurs.

Once the copy sheet lead edge has been captured and lifted up by the automatic pivoting stripping head 24 into line with the guide surface 26, the sheet continues on across the guide surface 26 retained by its fixed vacuum apertures 30 as well as the apertures 40 in the stripping head. Once the copy sheet trail edge passes the stripping head 24, the stripping apertures 40 become unobstructed and the pneumatic force thereon automatically drops so that a stripper head is again free to automatically move back into its initial position by gravity or spring force.

With the present system, since the stripping head 24 is not always maintained at the same position from the imaging surface, the paper path configuration is no longer limited by the stripping position of the stripping head. Thus, the stripping position 34 for the body of the copy sheet can be controlled by a member other than the stripper head. Here it is controlled by a fixed portion of the manifold guide surface 26 such as a stripping guide 56 positioned upstream from the stripping head 24. Thus, the present system allows optimization of the detack and stripping configuration and locations. This can include curvature of the lead edge area of the stripping head to guide curled up paper, and angling downstream of the lines of the stripping apertures 40 without changing the stripping point for the body of the copy sheet.

It will be appreciated that the large area of the stripping apertures 40 may increase the sliding friction of the stripped copy sheet over the stripper head surface 42 unless the vacuum applied to the stripper head is reduced after the stripping head has been lifted into line with the vacuum manifold unit. However, it may be desirable in any case to provide a vacuum belt transport to provide a more positive drive for the paper downstream from the stripping head 24 as shown, for example, in the above-cited U.S. Pat. Nos. 3,885,785 and 3,895,793. A more positive drive of the copy sheet will prevent paper from stalling on the guide surface 26 and therefor slipping relative to the imaging surface 14. An automatic reduction of the vacuum force on the copy sheet at the stripping head once the stripping head is fully lifted could be provided, for example, by stationary plugs or seals mating with at least some of the apertures 40 at the interior surface 42 in the fully lifted position of the stripping head 24. It will be noted that less force is required to maintain the stripping head 24 in its lifted position since its center of mass has pivoted closer to its pivotal axis 36 in the raised position.

It will also be appreciated that the vacuum manifold unit may be internally partitioned, or other arrangements provided, whereby a vacuum system is provided for the stripping head 24 separate from the rest of the copy sheet transport system. That is, the vacuum apertures 30 in the guide surface 26 can be provided with a different vacuum source and level, if desired. However, it may be seen that there is an advantage with the present system in that the vacuum pressure level at the apertures 30 may be kept low until a copy sheet is brought into contact therewith and then is automatically raised for more positive sheet retention when the apertures 40 are covered.

While the stripping head 24 and vacuum manifold unit 28 herein are an integral unit, it will be appreciated that many different configurations and arrangements of a movable vacuum stripping head and any suitable copy sheet transport mechanism may be utilized. The entire transfer, detack and stripper head can act to ride on shoes or slides on the drum edge to maintain the desired spacing from the photoreceptor surface and avoid drum run-out changes in the spacing.

The stripping ports 40 are illustrated here as extending along the entire stripping head. It will be appreciated that the length of the stripper head and/or the length of its apertured area will be preferably designed to be less than the width of the copy sheets. The entire lead edge width does not need to be captured to strip a copy sheet, and since this minimizes contaminant pick-up and air flow requirements.

In conclusion, there may be seen that there has been disclosed herein one embodiment of an improved copy sheet stripping system. It will be appreciated that various modifications and improvements may be made therein by those skilled in the art. The following claims are intended to encompass all such modifications and improvements as fall within the spirit and scope of the invention.

What is claimed is:

1. In a copying apparatus in which images on a reusable initial image support surface are transferred to copy sheets in electrostatically adhering engagement with said initial image support surface, and in which the electrostatically adhering copy sheets bearing the transferred images are stripped from the initial image support surface, the improvement comprising:

copy sheet transport means substantially spaced from said initial image support surface for transporting copy sheets away from said initial image support surface;

a highly apertured stripper head with a highly apertured unobstructed stripping surface normally closely overlying said initial image support surface, wherein the ratio of the apertured surface area to the non-apertured surface area of said stripping surface of said stripper head is greater than 1 to 1, and said apertures extend through said stripper head to provide substantially unrestricted air flow through said stripper head, said stripper head being freely pivotally mounted for rapid movement away from said initial image support surface toward said copy sheet transport means, and vacuum means applying a high air flow through said stripper head through said apertures therein sufficient to pneumatically strip a lead edge area of a single copy sheet electrostatically adhered to said initial image support surface away from said initial image support surface to said stripping surface, but with a low vacuum pressure only slightly below ambient pressure, which vacuum pressure is insufficient to pivot said stripper head away from said normal position closely overlying said image support surface, said stripper head being automatically pneumatically self-actuated by said same vacuum means to pivot said stripper head and the lead edge area of said copy sheet away from said initial image support surface toward said copy sheet transport means solely by the coverage of said apertures in said stripping surface by said single copy sheet stripped from said initial image support surface increasing the vacuum force on said stripper head, said stripper head being so pivoted by a distance sufficient to substantially shift the stripping point of said copy sheet from said initial image support surface.

2. The copying apparatus of claim 1, wherein the ratio of the apertured surface area to the non-apertured surface area of said stripper head stripping surface is at least ten to one.

3. The copying apparatus of claim 1, wherein said copy sheet transport means is a stationary apertured vacuum manifold copy sheet guide member for slidable movement of copy sheets thereover, and wherein said stripper head is self-pivotable into and out of alignment with said copy sheet transport means by said vacuum means, and wherein said vacuum means is commonly pneumatically connected to said vacuum manifold and to said stripper head.

4. The copying apparatus of claim 3, wherein said vacuum means normally maintains a low pressure level only slightly below ambient pressure in said vacuum manifold due to said highly apertured stripper head until said apertures are covered by said copy sheet, and wherein the vacuum pressure is increased at the apertures of said vacuum manifold automatically in response to the coverage of said apertures in said stripper head by said copy sheet.

5. The copying apparatus of claim 4, wherein said normally closely overlying spacing of said stripping surface of said stripper head from said initial image support surface is between approximately 20 to 80 one-thousandths of an inch.

6. The copying apparatus of claim 5, wherein the ratio of the apertured surface area to the non-apertured surface area of said stripper head stripping surface is at least ten to one.

* * * * *